US006286743B1

(12) United States Patent
Ehmig

(10) Patent No.: US 6,286,743 B1
(45) Date of Patent: Sep. 11, 2001

(54) EXPLOSIVE POWDER CHARGE-OPERATED SETTING TOOL

(75) Inventor: Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/500,301

(22) Filed: Feb. 8, 2000

(30) Foreign Application Priority Data

Feb. 11, 1999 (DE) ..... 199 05 896

(51) Int. Cl.[7] ..... B25C 1/14; F41C 11/00
(52) U.S. Cl. ..... 227/9; 227/10; 89/26
(58) Field of Search ..... 227/10, 9, 8, 11; 89/1.14, 26

(56) References Cited

U.S. PATENT DOCUMENTS

| | | | | |
|---|---|---|---|---|
| 2,117,885 | * | 5/1938 | Hasek | 89/26 |
| 3,552,625 | * | 1/1971 | Udert | 227/10 |
| 3,572,729 | * | 3/1971 | Hodil, Jr. | 89/26 |
| 3,777,614 | * | 12/1973 | Scanlon | 89/26 |
| 3,783,737 | * | 1/1974 | Ashley | 89/26 |
| 3,981,424 | * | 9/1976 | Maier | 227/10 |
| 4,263,836 | * | 4/1981 | Koine | 227/10 |
| 4,368,588 | * | 1/1983 | Jochum et al. | 227/10 |
| 5,177,317 | * | 1/1993 | Walker et al. | 89/1.14 |
| 5,617,925 | * | 4/1997 | Boothby et al. | 227/10 |
| 5,777,256 | * | 7/1998 | Simon et al. | 89/26 |

* cited by examiner

*Primary Examiner*—Scott A. Smith
(74) *Attorney, Agent, or Firm*—Sidley Austin Brown & Wood, LLP

(57) ABSTRACT

An explosive powder charge-operated setting tool including a first part provided with a cartridge socket (3), an opposite second part having a mating surface (14) which partially covers an axial projection surface of the cartridge socket (3), a circular cut-out (7) provided adjacent to the first part, and at least one connection channel (13), and an annular sealing member (9) located in the circular cut-out (7) of the second part and displaceable parallel to a setting direction relative to the second part (2), with the sealing member (9) being supported on the first part outside of the cartridge socket (3), and with the at least one connection channel (13) extending from the cartridge socket (3) up to a working surface (16) of the sealing member (9) facing in a direction opposite to the setting direction.

8 Claims, 2 Drawing Sheets

EXPLOSIVE POWDER CHARGE-OPERATED SETTING TOOL

BACKGROUND OF THE INVENTION

1. Field of the Invention

The present invention relates to an explosive powder-charge operated setting tool including a first part provided with a cartridge socket, an opposite second part having a mating surface which partially covers an axial projection surface of the cartridge socket, a circular cut-out provided adjacent to the first part, and at least one connection channel, and an annular sealing member located in the circular cut-out of the second part, with the sealing member being supported on the first part outside of the cartridge socket, and with the at least one connection channel extending from the cartridge socket up to a working surface of the sealing member facing in a direction opposite to the setting direction.

2. Description of the Prior Art

International application WO96/39281 discloses an explosive powder charge-operated setting tool having a guide cylinder with an inner bore in which a drive piston is displaceably arranged. A breech block, which is arranged coaxially with the guide cylinder, adjoins the guide cylinder at its side facing in a direction opposite to the setting direction. The breech block is provided with a cartridge socket in its region facing in the setting direction. The inner width of the cartridge socket increases toward the free end of the breech block.

The guide cylinder has, in its end region facing in a direction opposite to the setting direction, a circular cut-out in which a sealing member is fixedly arranged. The circular cut-out divides the end region of the guide cylinder, that faces in the direction opposite to the setting direction, in a central cylindrical section and a circular outer section which surrounds the central cylindrical section. The free end of the central cylindrical section forms a mating surface which secures a cartridge in the cartridge socket. The mating surface projects beyond the remaining portion of the end surface in the direction opposite to the setting direction.

Upon ignition or firing of the cartridge, the propellant gas pressure reaches, through the connection channel which connects the cartridge socket with the cut-out, the inner wall of the circular sealing member which has a U-shaped cross-section the opening of which is opened toward the central longitudinal axis of the sealing member. The propellant gas pressure, which is generated upon firing of the cartridge, does not act only in the setting direction in the setting tool disclosed in the above-mentioned International application. Rather, it also acts in two parallel directions opposite to the setting direction, so that the sealing member expands in two opposite directions.

Accordingly, an object of the present invention is to provide an explosive powder charge-operated setting tool in which the sealing element reliably seals the cartridge-receiving chamber and is pressed toward the first part with a bearing pressure corresponding to the propellant gas pressure.

SUMMARY OF THE INVENTION

This and other objects of the present invention, which will become apparent hereinafter, are achieved by providing an explosive powder charge-operated setting tool including a first part provided with a cartridge socket, an opposite second part having a mating surface which partially covers an axial projection surface of the cartridge socket, a circular cut-out provided adjacent to the first part, and at least one connection channel, and an annular sealing member located in the circular cut-out of the second part and displaceable parallel to a setting direction relative to the second part, with the sealing member being supported on the first part outside of the cartridge socket, and with the at least one connection channel extending from the cartridge socket up to a working surface of the sealing member facing in a direction opposite to the setting direction.

The arrangement of the circular sealing member according to the present invention provides for pressing of the sealing member against the first part dependent on the propellant gas pressure. Upon firing of the cartridge, the generated propellant gas pressure is conducted through the connection channels, which are formed in the second part, to the bottom of the circular cut-out and there propagates along a working surface of the sealing member which faces in the direction opposite to the setting direction. The sealing member, which is displaceable in the cut-out parallel to the setting direction, will be pressed against the first part, via an intermediate member and the cartridge cover, to a greater or smaller degree, dependent on the magnitude of the propellant gas pressure.

In order to insure that the propellant gas, which is generated upon firing of the cartridge, reaches the working surface of the sealing member, the sealing member should be spaced from the cut-out bottom. To this end, the distance between the flanged section of the sealing member and the working surface of the sealing member is smaller than the depth of the cut-out measured parallel to the setting direction. With the flanged section, the sealing member is supported, in the direction opposite to the setting direction, against an end surface of the second part facing in the setting direction.

A small amount of the propellant gas, which acts on the working surface of the sealing member, can escape between the outer surface or wall of the sealing member and the outer wall of the circular cut-out.

In order to carry away this small amount of the escaped propellant gas from the setting tool interior, advantageously, a ventilation channel is provided, which extends between the flanged section of the sealing member and the stop surface offset with respect to the mating surface in a direction opposite to the setting direction.

In order to prevent leakage of the propellant gas between the outer wall of the sealing member and the outer wall of the circular cut-out, the sealing section of the sealing member, advantageously, cooperates with a sealing region of the circular cut-out.

For economical and manufacturing reasons, advantageously, the sealing region is formed by at least one plate seal arranged in a side groove formed in the circular cut-out.

In order to provide for a large-surface support of the cartridge in the cartridge socket, advantageously the largest inner width of the cartridge socket projects, in the radial direction, beyond a mating surface of the second part.

In order to arrange the cartridge socket as close as possible to the inner bore of the guide cylinder, preferably, the first part is formed as a guide cylinder, and the second part is formed as a breech block.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
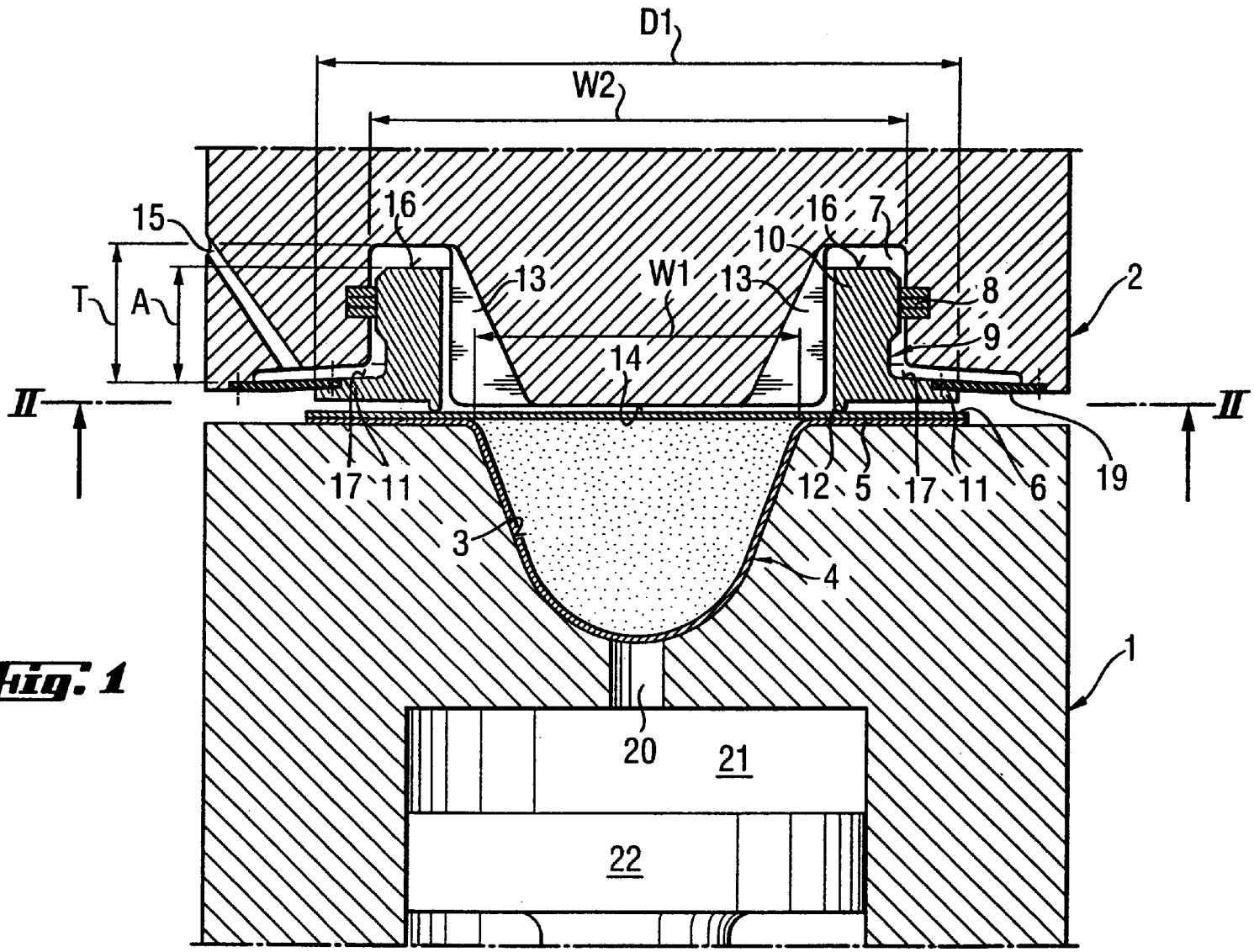
FIG. 1 a partial cross-sectional view of an explosive powder charge-operated setting tool according to the present invention.

An explosive powder charge-operated setting tool according to the present invention, which is shown in FIG. 1, has a first part in a form of a guide cylinder 1 and a second part in a form of a breech block 2. Both the guide cylinder 1 and the breech block 2 are coaxially arranged and are displaceable relative to each other in the setting direction. The end region of the guide cylinder 1 adjacent to the breech block 2 is provided with a cartridge socket 3 the inner width W1 of which increases toward the breech block 2. An inner bore 21 adjoins the cartridge socket 3 in the setting direction. A drive piston 22 is displaceably arranged in the inner bore 21. A connection bore 20 connects the inner bore 21 with the cartridge socket 3.

A cartridge 4 is arranged in the cartridge socket 3. The cartridge 4 has a receiving member 5 with, e.g., a plurality of receiving regions which receive, e.g., a powdered propellant charge. Only one receiving region is shown in FIG. 1. The receiving regions are closed by a cover 6. Both the receiving region 5 and the cover 6 are formed of a thin film.

The breech block 2 serves, together with a sealing member 9, for securing the cartridge 4 in the cartridge socket 3. At its side adjacent to the cartridge socket 3, the breech block 2 has a circular cut-out 7 which divides an end region of the breech block 2 adjacent to the cartridge socket 3 into a cylindrical section and an outer circular section surrounding the cylindrical section and spaced therefrom.

Figure 2:
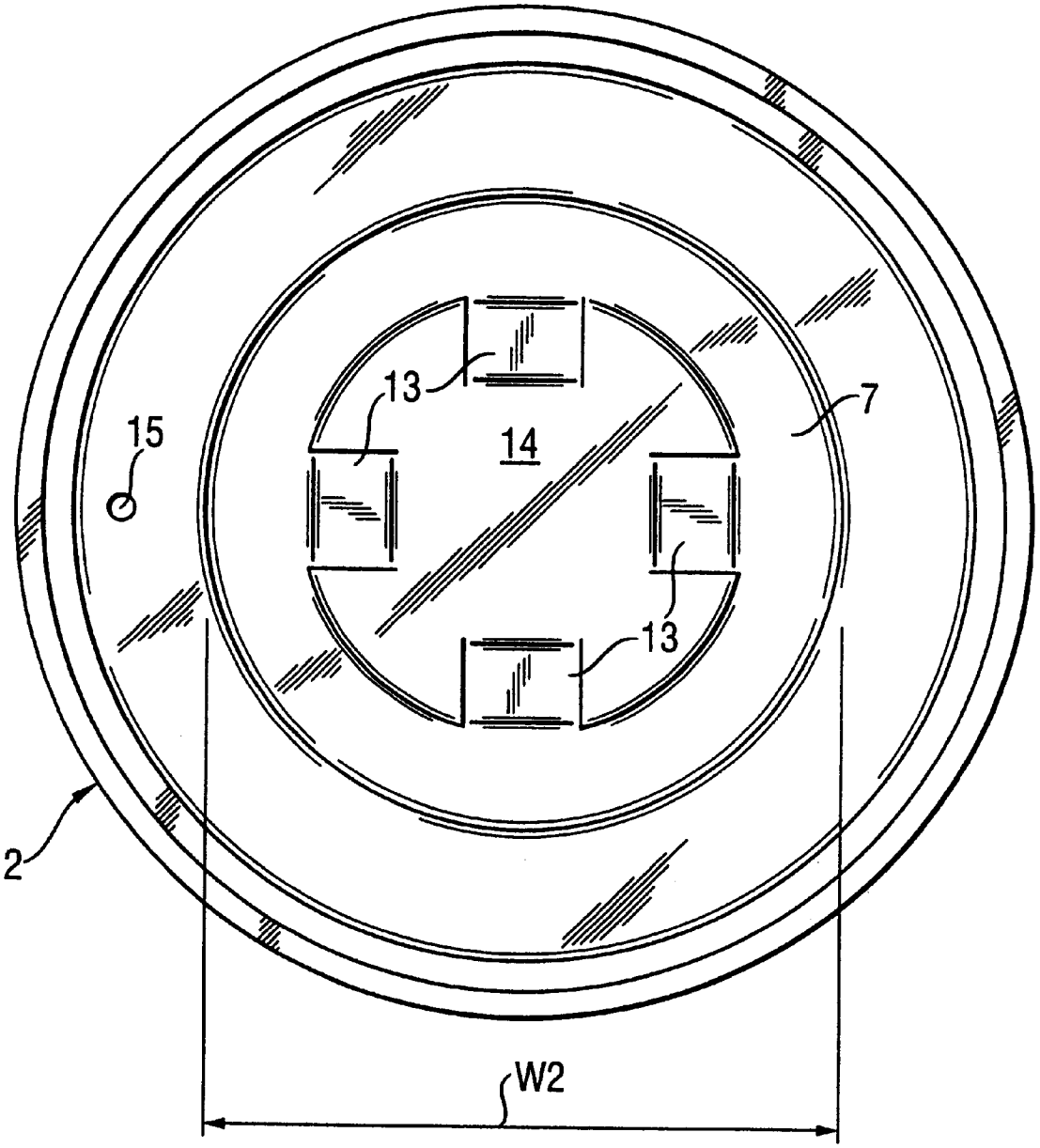
FIG. 2 a view of a breech block of the explosive powder charge-operated setting tool according to the present invention, which is shown in FIG. 1, as seen along line II—II.

As shown in FIG. 2, four connection channels 13 are provided in the circumferential region of the cylindrical section. The channels 13 extend from a bottom of the circular cut-out 7 up to the mating surface 14 that is formed by an end surface of the cylindrical section adjacent to the cartridge socket 3. The width of the connection channels 13 increases toward the mating surface 14.

The cartridge socket 3 has its largest inner width WI projecting, in a radial direction, from the mating surface 14, at least beyond regions located between the connection channels 13. The mating surface 14, as a result, partially covers the axial projection surface 3' of the cartridge socket 3.

The sealing member 9 is arranged in a region of the circular cut-out 7 having the largest inner width W2. The sealing member 9 is formed of a substantially hollow sealing section 10 and a flanged section 11 having an outer diameter D1. The flanged section 11 is provided in the end region of the sealing member 9 facing in the setting direction. The flanged section 11 has a stop surface 17 facing in a direction opposite to the setting direction. The depth T of the circular cut-out 7 is larger than the distance A between the flanged section 11 and an engageable surface 16 that is formed by a free end of the sealing section 10 facing in a direction opposite to the setting direction.

The sealing section 10 has, e.g., an outer profile slightly bulging outwardly and which cooperates with a sealing region 8. The sealing region 8 is formed, e.g., of three plate seals shaped as annular washers. The plate seals are resiliently deflectable in the radial direction. The plate seals project partially into a circular groove formed in the outer wall of the circular cut-out 7, and partially into space surrounded by the outer wall of the cut-out 7.

The sealing section 10 of the annular sealing member 9 and the sealing region of the breech block 2 in the region of the circular cut-out 7 can be provided with matching meshing thread profiles, forming, e.g., a labyrinth.

An end surface of the annular sealing member 9 facing in the setting direction is provided with a sealing lug 12 formed by a circular thin-walled projection. The inner wall of the lug-forming projection, which is located adjacent to the central cylindrical region of the breech block 2 has the same radius as the inner wall of the annular sealing member 9.

The end surface of the breech block 2 facing in the setting direction has a recess which extend radially outwardly from the outer profile of the circular cut-out 7 but not up to the outer profile of the breech block. A ventilation channel 15 opens into this recess.

The circumferential region of the flanged section 11 of the sealing member 9 is connected with a washer-shaped elastic diaphragm 19 which is fixedly secured to the end surface of the breech block 2 facing in the setting direction. The central cylindrical section has its end surface, which forms the mating surface 14, projecting, in the setting direction, beyond the end surface of the breech block 2.

Though the present invention was shown and described with references to the preferred embodiment, such is merely illustrative of the present invention and is not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. An explosive powder charge-operated setting tool comprising a first part provided with a cartridge socket (3); an opposite second part having a mating surface (14) which partially covers an axial projection surface (3') of the cartridge socket (3), a circular cut-out (7) provided adjacent to the first part and dividing an end region of the second part adjacent to the cartridge socket into a central section and an outer section surrounding the central section and spaced therefrom, and at least one connection channel (13); and an annular sealing member (9) located in the circular cut-out (7) of the second part and displaceable parallel to a setting direction relative to the second part (2), the sealing member (9) being supporting on the first part outside of the cartridge socket (3), and the at least one connection channel (13) being provided in a circumferential region of the central section and extending from the cartridge socket (3) up to a working surface (16) of the sealing member (9) facing in a direction opposite to the setting direction.

2. A setting tool according to claim 1, wherein the sealing member (9) comprises a sealing section (10), and a flanged section (11) provided at an end region of the sealing section (10) facing in the setting direction, the flanged section (10)

having an outer profile (D1) larger than a largest inner width (W2) of the circular cut-out (7).

3. A setting tool according to claim 2, wherein a distance (A) between the flanged section (10) and the working surface (16) of the sealing member (9) is smaller than a depth (T) of the circular cut-out (7) taken parallel to the setting direction.

4. A setting tool according to claim 2, wherein a ventilation channel (15) extends between the flanged section (11) and an outer profile of the second part.

5. A setting tool according to claim 2, further comprising a sealing region (8) of the circular cut-out (7) which cooperates with the sealing section (10) of the sealing member (9).

6. A setting tool according to claim 5, wherein the sealing region (8) is formed by at least one plate seal arranged in a side groove formed in the circular cut-out (7).

7. A setting tool according to claim 1, wherein a largest inner width (W1) of the cartridge socket (3) projects radially beyond a mating surface (14) of the second part (2).

8. A setting tool according to claim 1, wherein the first part is formed as a guide cylinder (1) and the second part is formed as a breech block (2).

* * * * *